US012221259B2

(12) United States Patent
Li et al.

(10) Patent No.: US 12,221,259 B2
(45) Date of Patent: Feb. 11, 2025

(54) CONTAINER SEALING PLUG AND CONTAINER

(71) Applicant: Huacheng Li, Lianjiang (CN)

(72) Inventors: Huacheng Li, Lianjiang (CN); Jiejia Xie, Lianjiang (CN)

(73) Assignee: Huacheng Li, Lianjiang (CN)

( * ) Notice: Subject to any disclaimer, the term of this patent is extended or adjusted under 35 U.S.C. 154(b) by 0 days.

(21) Appl. No.: 18/513,567

(22) Filed: Nov. 19, 2023

(65) Prior Publication Data

US 2024/0083645 A1 Mar. 14, 2024

Related U.S. Application Data

(63) Continuation-in-part of application No. 18/363,744, filed on Aug. 2, 2023.

(30) Foreign Application Priority Data

Oct. 24, 2023 (CN) ..... 202322868423.2

(51) Int. Cl.
*B65D 59/02* (2006.01)
*B65D 47/20* (2006.01)
*B65D 53/02* (2006.01)

(52) U.S. Cl.
CPC ..... *B65D 59/02* (2013.01); *B65D 47/2031* (2013.01); *B65D 53/02* (2013.01); *B65D 2539/003* (2013.01)

(58) Field of Classification Search
CPC .... B65D 59/02; B65D 47/2031; B65D 53/02; B65D 2539/003; B65D 47/127; B65D 39/0005; B65D 55/16; B65D 2547/06
USPC ..... 220/375; 215/306
See application file for complete search history.

(56) References Cited

U.S. PATENT DOCUMENTS 4,132,225 A * 1/1979 Whattam ..... A61B 5/153 600/580
5,464,111 A * 11/1995 Vacek ..... B65D 51/18 215/249
5,545,450 A * 8/1996 Andersen ..... B29C 44/0407 428/152

(Continued)

FOREIGN PATENT DOCUMENTS

DE 2551162 A * 5/1976 ..... A61J 1/10
GB 2299986 A * 10/1996 ..... B65D 39/0023

*Primary Examiner* — J. Gregory Pickett
*Assistant Examiner* — Niki M Eloshway
(74) *Attorney, Agent, or Firm* — Hemisphere Law, PLLC; Zhigang Ma

(57) ABSTRACT

The present disclosure provides a container sealing plug. The container sealing plug including a plug body. The plug body is configured to seal a receiving opening of a container. The plug body includes a sealing part. The sealing part is configured to seal the receiving opening of the container. The sealing part is provided with a flexible sealing ring. The sealing ring is configured to press an inner wall that seals the receiving opening of the sealed container. A user can place food, liquid, or other objects into the container through the receiving opening of the container, and then seal the receiving opening of the container through the plug body. When the flexible sealing ring of the plug body is inserted into the receiving opening of the container, the inner wall of the receiving opening presses the flexible sealing ring.

18 Claims, 5 Drawing Sheets

(56) References Cited

U.S. PATENT DOCUMENTS

| | | | | |
|---|---|---|---|---|
| D406,238 | S * | 3/1999 | Voller | D23/233 |
| D679,589 | S * | 4/2013 | Hauth | D9/446 |
| D948,929 | S * | 4/2022 | Zhang | D7/392.1 |
| 11,690,994 | B1 * | 7/2023 | Banik | A61M 39/20 604/103 |
| D993,768 | S * | 8/2023 | Xie | D9/446 |
| 2005/0184026 | A1 * | 8/2005 | Haley | B65D 47/32 222/484 |
| 2010/0089916 | A1 | 4/2010 | Fielden | |
| 2012/0091136 | A1 | 4/2012 | Gingras | |
| 2013/0020316 | A1 | 1/2013 | Hong | |
| 2019/0210859 | A1 * | 7/2019 | Lambrecht | B67D 1/0004 |
| 2019/0389630 | A1 * | 12/2019 | Kirchner | B65D 39/0076 |

* cited by examiner

CONTAINER SEALING PLUG AND CONTAINER

CROSS-REFERENCE TO RELATED APPLICATIONS

This application is a Continuation-in-Part of the U.S. application Ser. No. 18/363,744 filed on 2 Aug. 2023, entitled "CONTAINER SEALING PLUG AND CONTAINER HAVING SAME", now pending, and claims priority of China No. 2023228684232, filed on 24 Oct. 2023, the entire disclosures of which are incorporated herein by reference.

TECHNICAL FIELD

The present disclosure relates to the field of containers, and in particular, to a container sealing plug and a container.

BACKGROUND

A sealed container is a kind of container for storing and preserving food, liquid or other objects, which can effectively prevent the entrance or leakage of air or water. Such a container generally has a reliable sealing mechanism for guaranteeing the long-term storage and freshness preservation of contents. The sealed container generally is made of a durable material, such as plastic, glass, or metal. Different types of sealed containers are suitable for different purposes and requirements. Current sealed containers available on the market generally have a sealing structure. However, the sealing structures currently available on the market mostly are not integrally formed with the containers and easy to slip and lose, and only has a single sealing function. Therefore, there is a strong need to provide a container sealing plug which has a good sealing effect, is not easy to slip or lose, and has a plenty of functions, and a container.

SUMMARY

In order to overcome the shortcomings of the prior art, the present disclosure provides a container sealing plug, including: a plug body, wherein the plug body is configured to seal a receiving opening of a container; the plug body includes a sealing part; the sealing part is configured to seal the receiving opening of the container; the sealing part is provided with an elastic sealing ring; and the sealing ring is configured to press an inner wall of the receiving opening of the sealed container.

As the improvement of the present disclosure, the plug body is an integrally formed plug body.

As the improvement of the present disclosure, the plug body is a silica gel plug body or a rubber plug body, and a hardness range of the plug body is 30-80 Shore A.

As the improvement of the present disclosure, the plug body includes a first upper side and a first lower side; the plug body further includes a first stop part; the first stop part is arranged between the first upper side and the first lower side; and the sealing part is arranged between the first lower side and the stop part.

As the improvement of the present disclosure, the first lower side is provided with a first opening; the first upper side is provided with a second opening; the first opening is intercommunicated with the second opening; and when the first lower side of the plug body is inserted into the receiving opening of the container, the second opening is inserted into the container along with the plug body, and the first upper side is exposed out of the container, whereby the second opening on the first upper side is exposed out of the container.

As the improvement of the present disclosure, the container sealing plug further includes a cover body and a second flexible member, wherein the cover body is connected to the plug body through the second flexible member, and the cover body is detachably covered at the second opening.

As the improvement of the present disclosure, a leak-proof part is arranged at the second opening, and the leak-proof part includes a plurality of flexible leak-proof baffles and slits; the flexible leak-proof baffles press one another to cover the slits; and when the flexible leak-proof baffles are acted upon by an external force that is greater than a pressing force generated by the flexible leak-proof baffles pressing one another, the flexible leak-proof baffles uncover the slits.

As the improvement of the present disclosure, the container sealing plug further includes a first flexible member, wherein the first flexible member is connected to the plug body; the first flexible member is provided with a first sleeving opening; the first sleeving opening is configured to be connected to the container; and the first flexible member is further provided with a hanging space.

As the improvement of the present disclosure, the first flexible member includes a first end and a second end; the first end is connected to the plug body; and the first sleeving opening and the hanging space are arranged in sequence in a direction from the first end of the first flexible member toward the second end.

As the improvement of the present disclosure, the sealing part at least includes one sealing ring, and the at least one sealing ring is uniformly arranged between the first lower side and the first stop part.

As the improvement of the present disclosure, the hanging space is a hanging port.

As the improvement of the present disclosure, the first end of the first flexible member is connected to one side of the first stop part.

As the improvement of the present disclosure, the cover body is connected to the other side of the first stop part of the plug body through the second flexible member.

As the improvement of the present disclosure, the first flexible member is a silica gel first flexible belt.

As the improvement of the present disclosure, the second flexible member is a silica gel second flexible belt.

As the improvement of the present disclosure, the first flexible belt, the second flexible belt, and the cover are integrally formed.

As the improvement of the present disclosure, a second stop part is further arranged between the first upper side and the first stop part, and the cover body includes a third stop part; and when the cover body is covered at the second opening, the third stop part abuts against the second stop part.

As the improvement of the present disclosure, the second stop part is a stop ring; and the third stop part is a stop ring groove arranged on an inner wall of the cover body.

As the improvement of the present disclosure, a radius of the first upper side of the plug body is less than a radius of the first lower side of the plug body.

The present disclosure also provides a container, including the container sealing plug described above.

Beneficial effects of the present disclosure are as follows: The present disclosure provides a container sealing plug, including a plug body, wherein the plug body is configured to seal a receiving opening of a container; the plug body includes a sealing part; the sealing part is configured to seal the receiving opening of the container; the sealing part is provided with a plurality of flexible sealing ring; and the sealing ring is configured to press an inner wall that seals the receiving opening of the sealed container. A user can place food, liquid, or other objects into the container through the receiving opening of the container, and then seal the receiving opening of the container through the plug body. When the flexible sealing ring of the plug body is inserted into the receiving opening of the container, the inner wall of the receiving opening presses the flexible sealing ring. An elastic resetting force generated when the sealing ring is pressed can press the inner wall that seals the receiving opening, which can effectively prevent air and water from entering or leaking out via the receiving opening of the container and ensure long-term storage and freshness preservation of contents.

BRIEF DESCRIPTION OF THE DRAWINGS

In order to explain the technical solutions of the embodiments of the present disclosure more clearly, the following will briefly introduce the accompanying drawings used in the embodiments. The drawings in the following description are only some embodiments of the present disclosure. Those of ordinary skill in the art can obtain other drawings based on these drawings without creative work.

The present disclosure is further described below in detail in combination with the accompanying drawings and embodiments.

DETAILED DESCRIPTION OF THE EMBODIMENTS

Embodiment I

Figure 1:
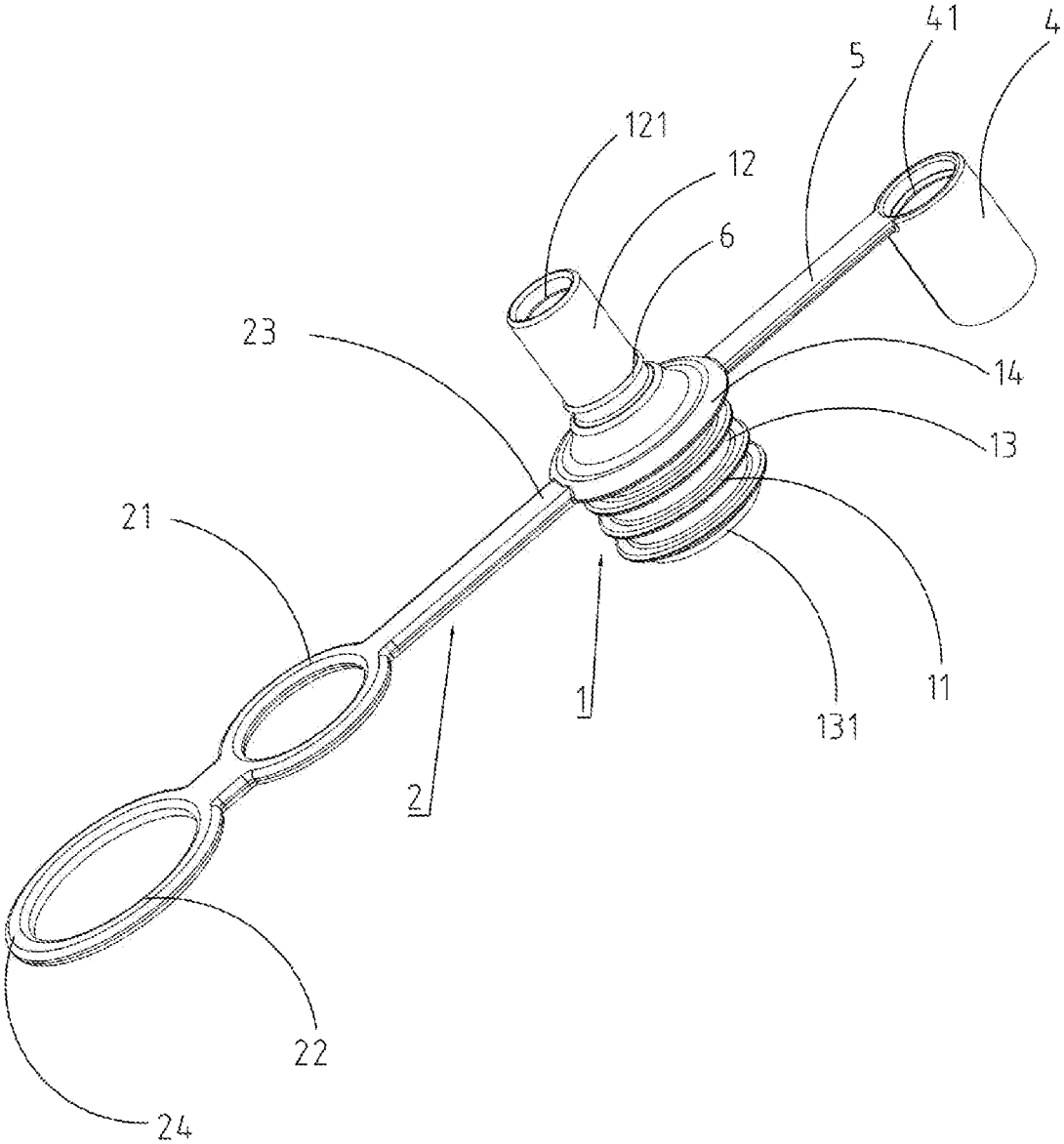
FIG. 1 is a schematic diagram of an entire structure of the present disclosure.
Figure 2:
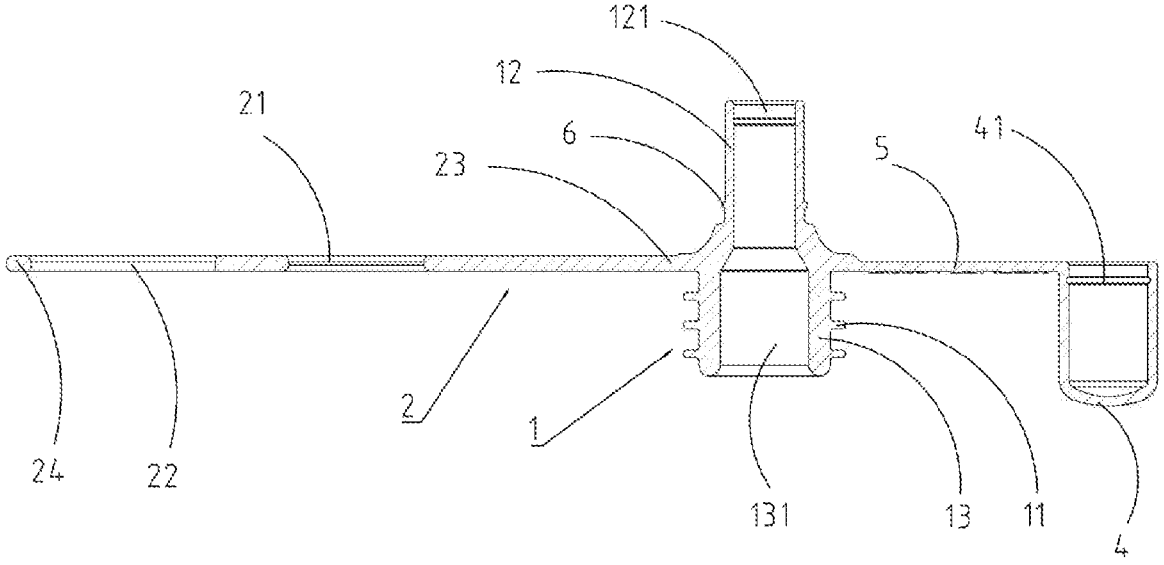
FIG. 2 is a sectional view cut along a plug body, a first flexible member, a second flexible member, and a cover body.
Figure 3:
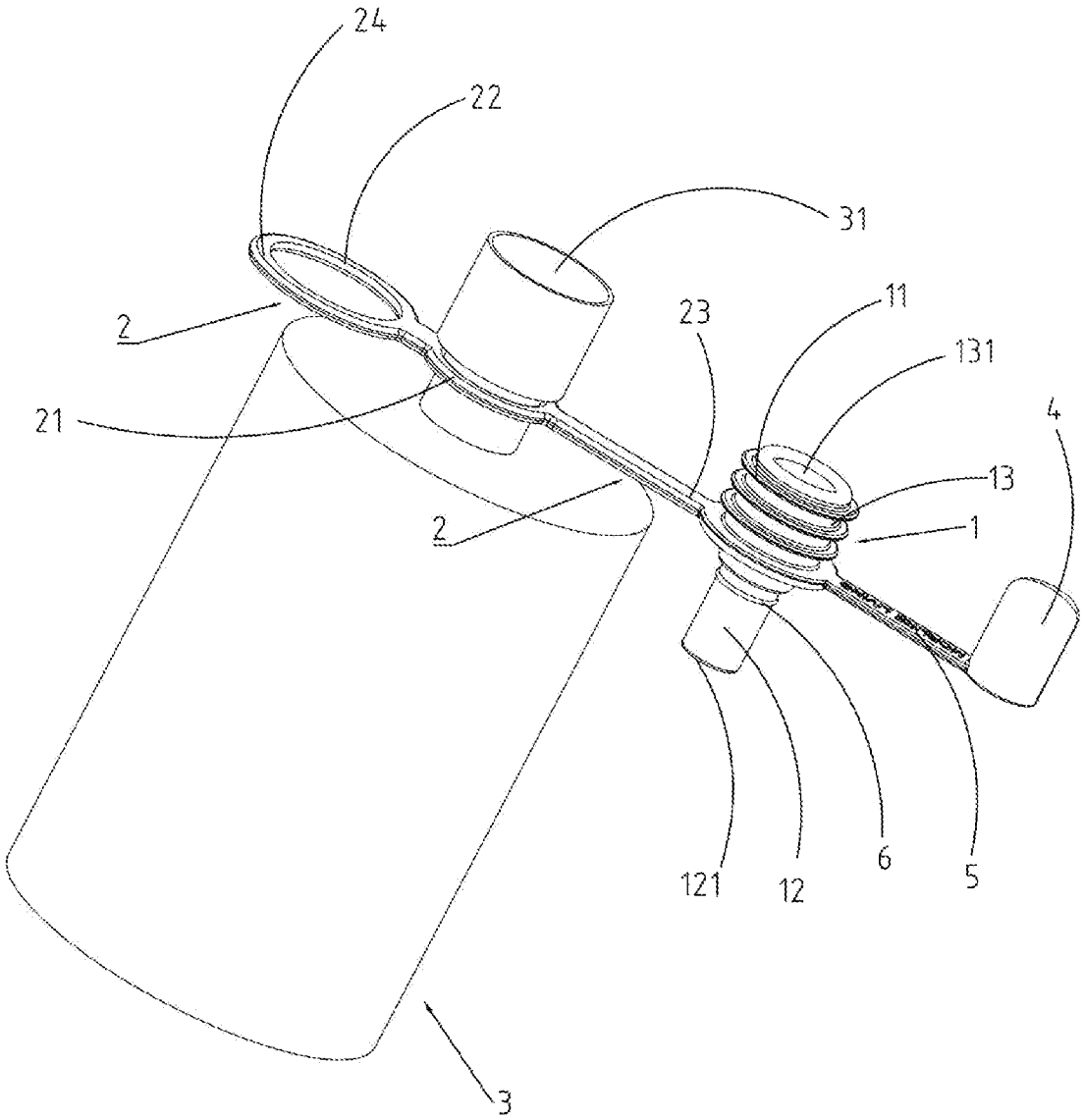
FIG. 3 is a schematic diagram of another entire structure of the present disclosure.
Figure 4:
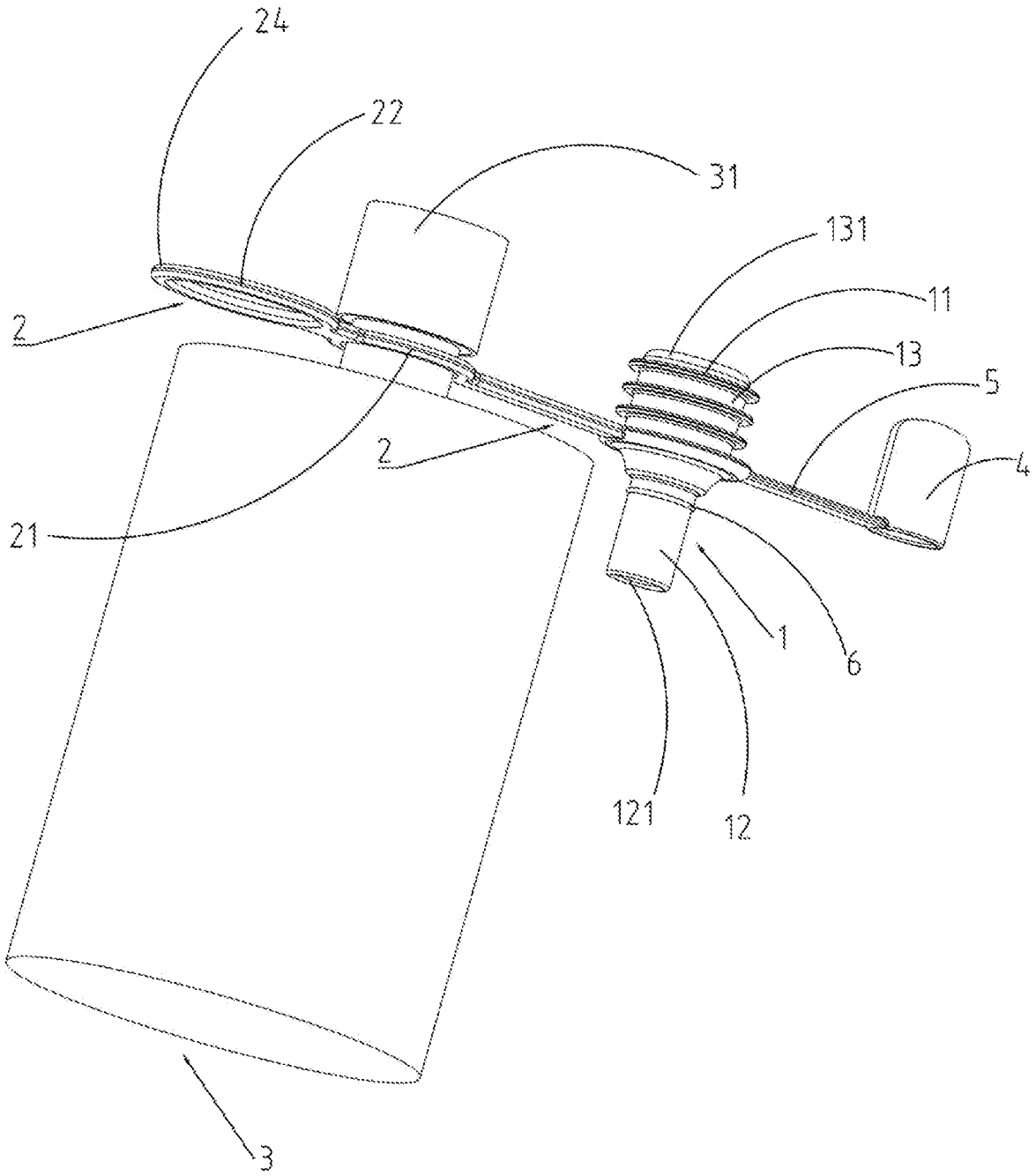
FIG. 4 is a schematic diagram of another entire structure of the present disclosure.
Figure 5:
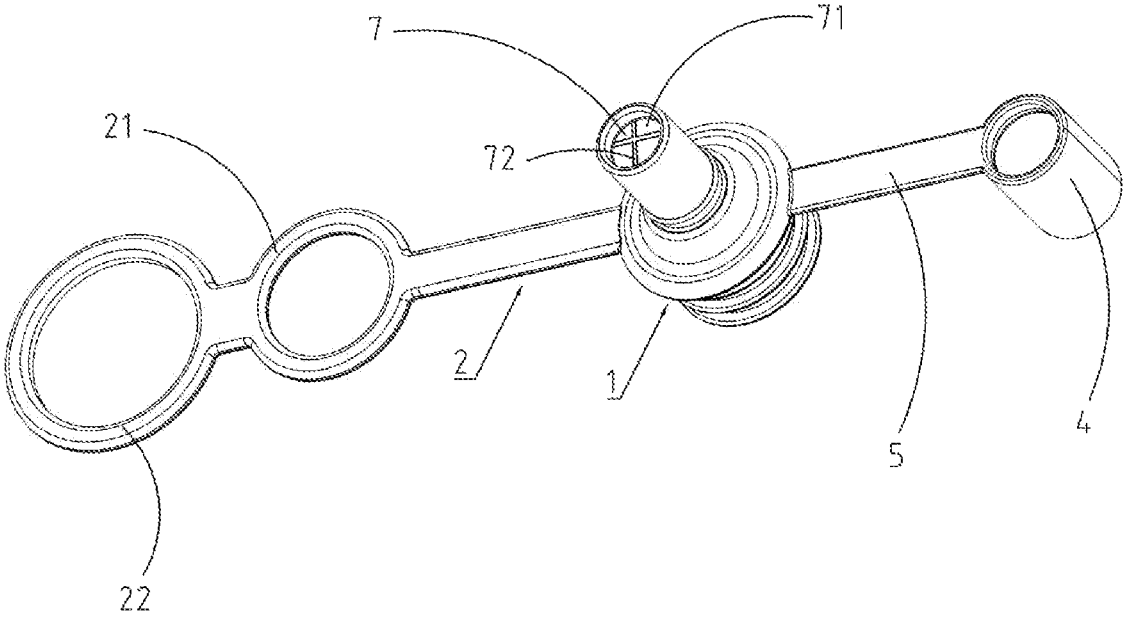
FIG. 5 is a schematic structural diagram of a leak-proof part of the present disclosure.

Referring to FIG. 1 to FIG. 5, a container sealing plug includes:

a plug body 1, wherein the plug body 1 is configured to seal a receiving opening 31 of a container 3; the plug body 1 includes a sealing part 11; the sealing part 11 is configured to seal the receiving opening 31 of the container 3; the sealing part 11 is provided with an elastic sealing ring; and the sealing ring is configured to press an inner wall that seals the receiving opening 31 of the sealed container 3. Through the above structure, a user can place food, liquid, or other objects into the container through the receiving opening of the container, and then seal the receiving opening of the container through the plug body. When the flexible sealing ring of the plug body is inserted into the receiving opening of the container, the inner wall of the receiving opening presses the flexible sealing ring. An elastic resetting force generated when the sealing ring is pressed can press the inner wall that seals the receiving opening, which can effectively prevent air and water from entering or leaking out via the receiving opening of the container and ensure long-term storage and freshness preservation of contents.

In this embodiment, the plug body 1 is an integrally formed plug body.

In this embodiment, the plug body 1 is a silica gel plug body or a rubber plug body, and a hardness range of the plug body 1 is 30-80 Shore A.

In this embodiment, the plug body 1 includes a first upper side 12 and a first lower side 13; the plug body 1 further includes a first stop part 14; the first stop part 14 is arranged between the first upper side 12 and the first lower side 13; and the sealing part 11 is arranged between the first lower side 13 and the stop part 14. The first lower side 13 is provided with a first opening 131; the first upper side 12 is provided with a second opening 121; the first opening 131 is intercommunicated with the second opening 121; and when the first lower side 13 of the plug body 1 is inserted into the receiving opening 31 of the container 3, the second opening 121 is inserted into the container 3 along with the plug body 1, and the first upper side 12 is exposed out of the container 3, whereby the second opening 121 on the first upper side 12 is exposed out of the container 3. Specifically, the container sealing plug further includes a cover body 4 and a second flexible member 5; the cover body 4 is connected to the plug body 1 through the second flexible member 5, and the cover body 4 is detachably covered at the second opening 121. Specifically, the sealing part 11 is a sealing ring. Further, the sealing part 11 at least includes one sealing ring, and the at least one sealing ring is uniformly arranged between the first lower side and the first stop part. Much further, a quantity of the sealing ring is three. The three sealing rings are uniformly arranged between the first lower side and the first stop part. Much further, the plug body 1 is a silica gel plug body 1. Through the above structure, the sealing ring of the silica gel plug body 1 can be inserted into the receiving opening 31 of the container 3 to seal the receiving opening 31 of the container 3. The sealing property is good, and the silica gel plug body 1 is not easy to age and is convenient to clean. Moreover, the arrangement of the first stop part 14 can effectively prevent the plug body 1 from being excessively inserted into the container 3 via the receiving opening 31 of the container 3, so as to prevent a phenomenon that the plug body 1 is difficultly pulled out of the opening in the container 3. Moreover, when the user needs to pour out liquid in the container 3, the cover body 4 can be removed from the second opening 121 to allow the liquid to flow out via the first opening 131 and the second opening 121.

In this embodiment, a leak-proof part 7 is arranged at the second opening 121, and the leak-proof part 7 includes a plurality of flexible leak-proof baffles 71 and slits 72; the flexible leak-proof baffles 71 press one another to cover the slits 72; and when the flexible leak-proof baffles 71 are acted upon by an external force that is greater than a pressing force generated by the flexible leak-proof baffles 71 pressing one another, the flexible leak-proof baffles 71 uncover the slits 72. Through the above structure, when the leak-proof baffles are not acted upon by an external force, the flexible leak-proof baffles 71 press one another to cover the slits 72, so as to prevent the liquid from flowing out via the first opening 131, the second opening 121, and the slits 72. When the user needs to pour out the liquid in the container 3 for drinking, a liquid impact force when the liquid is poured out of the container can impact the flexible leak-proof baffles 71 to cause the flexible leak-proof baffles 71 to uncover the slits 72, whereby the liquid flows out via the first opening 131, the second opening 121, and the slits 72. A quantity of the flexible leak-proof baffles is four, and the four flexible leak-proof baffles are uniformly arranged around an interior of the second opening. A cross shape is formed between the plurality of slits.

In this embodiment, the container sealing plug further includes a first flexible member 2; the first flexible member 2 is connected to the plug body 1; the first flexible member 2 is provided with a first sleeving opening 21; the first sleeving opening 21 is configured to be connected to the container 3; and the first flexible member 2 is further provided with a hanging space 22. Specifically, the hanging space 22 is a hanging port. Further, the hanging port is configured to hold a finger of the user. The first flexible member 2 includes a first end 23 and a second end 24; the first end 23 is connected to the plug body 1; and the first sleeving opening 21 and the hanging space 22 are arranged in sequence in a direction from the first end 23 of the first flexible member 2 toward the second end 24. Through the above structure, the user can place food, liquid, or other objects into the container 3 through the receiving opening 31 of the container 3, and then seal the receiving opening 31 of the container 3 through the plug body 1. This can effectively prevent air and water from entering or leaking out via the receiving opening 31 of the container 3 and ensure long-term storage and freshness preservation of contents. Furthermore, due to the arrangement of the first flexible member 2 connected to the plug body 1, the first sleeving opening 21 on the first flexible member 2 can sleeve the container 3, for example, on a side wall of the opening of the container 3, so that the plug body 1 is connected to the container 3 through the first flexible member 2 to effectively prevent slip and loss of the plug body 1. The container can be a water bottle or another type of container. Moreover, the design is reasonable, the structure is compact, and the connection is stable. When the plug body 1 sleeves the container 3 through the first sleeving opening 21 of the first flexible member 2, the user can insert a finger into the hanging port to lift the sealing plug and the container 3, making it easy for the user to carry the container 3. When the container 3 does not need to be used, the container 3 and the plug body 1 can also be hung on a wall or another external object through the hanging port, facilitating the user to store the container 3 and the plug body 1.

In this embodiment, the first end 23 of the first flexible member 2 is connected to one side of the first stop part 14. The cover body 4 is connected to the other side of the first stop part 14 of the plug body 1 through the second flexible member 5. Specifically, the first flexible member 2 is a silica gel first flexible belt. Further, the second flexible member 5 is a silica gel second flexible belt. Much further, the first flexible belt, the second flexible belt, and the cover are integrally formed. Through the above structure, the arrangement of the first flexible member 2 and the second flexible member 5 is effectively achieved; and the connection between the cover body 4 and the plug body 1 and the connection between the plug body 1 and the container 3 are achieved.

In this embodiment, a second stop part 6 is further arranged between the first upper side 12 and the first stop part 14, and the cover body 4 includes a third stop part 41; and when the cover body 4 is covered at the second opening 121, the third stop part 41 abuts against the second stop part 6. The second stop part 6 is a stop ring; and the third stop part 41 is a stop ring groove arranged on an inner wall of the cover body 4. Specifically, a radius of the first upper side 12 of the plug body 1 is less than a radius of the first lower side 13 of the plug body 1. Through the above structure, it is easy to accurately cover the second opening 121 with the cover body 4, preventing excessive coverage by the cover body 4 and preventing the cover body 4 from being cracked due to the excessive coverage.

A container is further provided, including the container sealing plug as described above. Through the above structure, a user can place food, liquid, or other objects into the container through the receiving opening of the container, and then seal the receiving opening of the container through the plug body. When the flexible sealing ring of the plug body is inserted into the receiving opening of the container, the inner wall of the receiving opening presses the flexible sealing ring. An elastic resetting force generated when the sealing ring is pressed can press the inner wall that seals the receiving opening, which can effectively prevent air and water from entering or leaking out via the receiving opening of the container and ensure long-term storage and freshness preservation of contents. Furthermore, due to the arrangement of the first flexible member 2 connected to the plug body 1, the first sleeving opening 21 on the first flexible member 2 can sleeve the container 3, for example, on a side wall of the opening of the container 3, so that the plug body 1 is connected to the container 3 through the first flexible member 2 to effectively prevent slip and loss of the plug body 1. The container can be a water bottle or another type of container.

Embodiment II

Referring to FIG. 1 to FIG. 5, a container sealing plug includes: a plug body 1 configured to seal a receiving opening 31 of a container body 3; and a first flexible member 2 connected to the plug body 1 and having a first sleeving opening 21 formed thereon, the first sleeving opening 21 being configured to connect to the container body 3.

By means of the above structure, a user can place food, liquid or other objects into the container body 3 through the receiving opening 31 of the container body 3, and then seal the receiving opening 31 of the container body 3 with the plug body 1, whereby air or water is effectively prevented from entering or leaking out the container body 3 through the receiving opening 31 of the container body 3 and thus the long-term storage and freshness preservation of the content is guaranteed. Due to the arrangement of the first flexible member 2 connected to the plug body 1, the first sleeving opening 21 on the first flexible member 2 can be sleeved on the container body 3, for example, on a side wall of an opening of the container body 3, so that the plug body 1 is connected to the container body 3 through the first flexible member 2, which effectively prevents the slipping and loss of the plug body 1. Herein, the container can be a water bottle, also can be other types of containers.

Herein, the first flexible member 2 has a hanging space 22 formed thereon. Specifically, the hanging space 22 is a hanging opening. Further, the hanging opening is configured for a user's finger to hang on. Still further, the first flexible member 2 includes a first end 23 and a second end 24. The first end 23 is connected to the plug body 1. The first sleeving opening 21 and the hanging space 22 are arranged sequentially in a direction from the first end 23 of the first flexible member 2 toward the second end 24. By means of the above structure, the sealing plug achieves a reasonable design, a compact structure, and a stable connection. When the plug body 1 is sleeved on the container body 3 by means of the first sleeving opening 21 of the first flexible member 2, a user can extend a finger into the hanging opening to lift up the sealing plug and the container body 3, which is convenient for the user to carry the container body 3. In addition, when the container body 3 is not in use, the container body 3 and the plug body 1 can be hung on a wall or other external objects by means of the hanging opening, which is convenient for a user to store the container body 3 and the plug body 1.

In the present embodiment, the plug body 1 includes a sealing part 11 configured to seal the receiving opening 31 of the container body 3. Herein, the plug body 1 includes a first upper side 12 and a first lower side 13 and further includes a first stop part 14. The first stop part 14 is arranged between the first upper side 12 and the first lower side 13; and the sealing part 11 is arranged between the first lower side 13 and the stop part 14. Specifically, the sealing part 11 is a sealing ring. Further, the number of the sealing ring is three. The three sealing rings are evenly arranged between the first lower side and the first stop part. Still further, the plug body 1 is a silicone plug body 1. By means of the above structure, the sealing rings of the silicone plug body 1 can be inserted into the receiving opening 31 of the container body 3 to seal the receiving opening 31 of the container body 3. The silicone plug body 1 not only has a good sealing property, but also is difficult to age and is easy to clean. In addition, due to the arrangement of the first stop part 14, the plug body 1 can be effectively prevented from being excessively inserted into the container body 3 through the receiving opening 31 of the container body 3, with the occurrence avoided that the plug body 1 is difficult to be pulled out from the opening of the container body 3.

In the present embodiment, the first lower side 13 is formed with a first opening 131, the first upper side 12 is formed with a second opening 121, and the first opening 131 is intercommunicated with the second opening 121. When the first lower side 13 of the plug body 1 is inserted into the receiving opening 31 of the container body 3, the second opening 121 is inserted into the container body 3 along with the plug body 1, and the first upper side 12 is exposed out of the container body 3, whereby the second opening 121 on the first upper side 12 is exposed out of the container body 3. Herein, a cover body 4 and a second flexible member 5 are further included, wherein the cover body 4 is connected to the plug body 1 through the second flexible member 5, and the cover body 4 detachably covers the second opening 121. By means of the above structure, when a user needs to pour out a liquid inside the container body 3, he/she can remove the cover body 4 from the second opening 121, so that the liquid can flow out through the first opening 131 and the second opening 121.

In the present embodiment, a leak-proof part 7 is provided at the second opening 121 and the leak-proof part 7 includes a plurality of flexible leak-proof baffles 71 and slits 72. The flexible leak-proof baffles 71 squeeze one another to cover the slits 72. When the flexible leak-proof baffles 71 are acted upon by an external force that is greater than a squeezing force generated by the flexible leak-proof baffles 71 squeezing one another, the flexible leak-proof baffles 71 uncover the slits 72. By means of the above structure, when the leak-proof baffles are not acted upon by an external force, the flexible leak-proof baffles 71 squeeze one another to cover the slits 72, whereby preventing a liquid flowing out through the first opening 131, the second opening 121 and the slits 72. When a user needs to pour out a liquid inside the container body 3 to drink, a liquid impact force arising from the pouring out of the liquid inside the container can impact on the flexible leak-proof baffles 71, whereby canceling the coverage of the flexible leak-proof baffles 71 on the slits 72, so that the liquid can flow out through the first opening 131, the second opening 121 and the slits 72. Herein, the number of the flexible leak-proof baffles are four. The four flexible leak-proof baffles are evenly disposed around an inside of the second opening. A cross shape is formed between the plurality of slits.

In the present embodiment, the first end 23 of the first flexible member 2 is connected to one side of the first stop part 14. Herein, the cover body 4 is connected to the other side of the first stop part 14 of the plug body 1 through the second flexible member 5. Specifically, the first flexible member 2 is a first flexible belt made of silicone. Further, the second flexible member 5 is a second flexible belt made of silicone. By means of the above structure, not only are the first flexible member 2 and the second flexible member 5 effectively achieved, but the connection between the cover body 4 and the plug body 1 and the connection between the plug body 1 and the container body 3 are achieved. Specifically, the first flexible belt, the second flexible belt and the cover are integrally formed.

In the present embodiment, a second stop part 6 is further arranged between the first upper side 12 and the first stop part 14, and the cover body 4 includes a third stop part 41. When the cover body 4 covers the second opening 121, the third stop part 41 abuts on the second stop part 6. Herein, the first upper side 12 of the plug body 1 has a smaller semi-diameter than the first lower side 13 of the plug body 1. The second stop part 6 is a stop ring. The third stop part 41 is a stop ring groove arranged on an inner wall of the cover body 4. By means of the above structure, the cover body 4 is easy to accurately cover the second opening 121, preventing the occurrence of excessive covering to result in crack of the cover body 4.

A container body 3 including the above container sealing plug. By means of the above structure, a user can place food, liquid or other objects into the container body 3 through the receiving opening 31 of the container body 3, and then seal the receiving opening 31 of the container body 3 with the plug body 1, whereby air or water is effectively prevented from entering or leaking out the container body 3 through the receiving opening 31 of the container body 3 and thus the long-term storage and freshness preservation of the content is guaranteed. Due to the arrangement of the first flexible member 2 connected to the plug body 1, the first sleeving opening 21 on the first flexible member 2 can be sleeved on the container body 3, for example, on a side wall of an opening of the container body 3, so that the plug body 1 is connected to the container body 3 through the first flexible member 2, which effectively prevents the slipping and loss of the plug body 1. Herein, the container can be a water bottle, also can be other types of containers.

One or more implementation modes are provided above in combination with specific contents, and it is not deemed that the specific implementation of the present disclosure is limited to these specifications. Any technical deductions or replacements approximate or similar to the method and structure of the present disclosure or made under the concept of the present disclosure shall fall within the scope of protection of the present disclosure.

What is claimed is:

1. A container sealing plug, comprising:

a plug body, wherein the plug body is configured to seal a receiving opening of a container; the plug body comprises a sealing part; the sealing part is configured to seal the receiving opening of the container; the sealing part is provided with an elastic sealing ring;

and the sealing ring is configured to press an inner wall that seals the receiving opening of the sealed container;

wherein the plug body comprises a first upper side and a first lower side; the plug body further comprises a first stop part; the first stop part is arranged between the first upper side and the first lower side; and the sealing part is arranged between the first lower side and the stop part;

wherein the first lower side is provided with a first opening; the first upper side is provided with a second opening; the first opening is intercommunicated with the second opening; and when the first lower side of the plug body is inserted into the receiving opening of the container, the second opening is inserted into the container along with the plug body, and the first upper side is exposed out of the container, whereby the second opening on the first upper side is exposed out of the container;

wherein the container sealing plug further comprises a cover body and a second flexible member, wherein the cover body is connected to the plug body through the second flexible member, and the cover body is detachably covered at the second opening;

wherein the container sealing plug further comprises a first flexible member; the first flexible member is connected to the plug body; the first flexible member is provided with a first sleeving opening; the first sleeving opening is configured to be connected to the container; and the first flexible member is further provided with a hanging space;

wherein the hanging space is a hanging opening, and the hanging opening is configured for a user's finger to hang on.

2. The container sealing plug according to claim 1, wherein the plug body is an integrally formed plug body.

3. The container sealing plug according to claim 1, wherein the plug body is a silica gel plug body or a rubber plug body, and a hardness range of the plug body is 30-80 Shore A.

4. The container sealing plug according to claim 1, wherein a leak-proof part is arranged at the second opening, and the leak-proof part comprises a plurality of flexible leak-proof baffles and slits; the flexible leak-proof baffles press one another to cover the slits; and when the flexible leak-proof baffles are acted upon by an external force that is greater than a pressing force generated by the flexible leak-proof baffles pressing one another, the flexible leak-proof baffles uncover the slits.

5. The container sealing plug according to claim 1, wherein the first flexible member comprises a first end and a second end; the first end is connected to the plug body; and the first sleeving opening and the hanging space are arranged in sequence in a direction from the first end of the first flexible member toward the second end.

6. The container sealing plug according to claim 1, wherein the sealing part at least comprises one sealing ring, and the at least one sealing ring is uniformly arranged between the first lower side and the first stop part.

7. The container sealing plug according to claim 1, wherein the hanging space is a hanging port.

8. The container sealing plug according to claim 1, wherein the first end of the first flexible member is connected to one side of the first stop part.

9. The container sealing plug according to claim 1, wherein the cover body is connected to the other side of the first stop part of the plug body through the second flexible member.

10. The container sealing plug according to claim 1, wherein the second flexible member is a silica gel second flexible belt.

11. The container sealing plug according to claim 1, wherein a second stop part is further arranged between the first upper side and the first stop part, and the cover body comprises a third stop part; and when the cover body is covered at the second opening, the third stop part abuts against the second stop part.

12. The container sealing plug according to claim 11, wherein the second stop part is a stop ring; and the third stop part is a stop ring groove arranged on an inner wall of the cover body.

13. The container sealing plug according to claim 1, wherein the hanging space and the cover body are arranged at two opposite sides of the plug body, and the hanging space, the cover body, and the plug body are arranged in a straight line.

14. A container sealing plug, comprising:

a plug body, wherein the plug body is configured to seal a receiving opening of a container; the plug body comprises a sealing part; the sealing part is configured to seal the receiving opening of the container; the sealing part is provided with an elastic sealing ring; and the sealing ring is configured to press an inner wall that seals the receiving opening of the sealed container;

wherein the plug body comprises a first upper side and a first lower side; the plug body further comprises a first stop part; the first stop part is arranged between the first upper side and the first lower side; and the sealing part is arranged between the first lower side and the stop part;

wherein the first lower side is provided with a first opening; the first upper side is provided with a second opening; the first opening is intercommunicated with the second opening; and when the first lower side of the plug body is inserted into the receiving opening of the container, the second opening is inserted into the container along with the plug body, and the first upper side is exposed out of the container, whereby the second opening on the first upper side is exposed out of the container;

wherein the container sealing plug further comprises a cover body and a second flexible member, wherein the cover body is connected to the plug body through the second flexible member, and the cover body is detachably covered at the second opening;

wherein a leak-proof part is arranged at the second opening, and the leak-proof part comprises a plurality of flexible leak-proof baffles and slits; the flexible leak-proof baffles press one another to cover the slits; and when the flexible leak-proof baffles are acted upon by an external force that is greater than a pressing force generated by the flexible leak-proof baffles pressing one another, the flexible leak-proof baffles uncover the slits;

wherein the container sealing plug further comprises a first flexible member, wherein the first flexible member is connected to the plug body; the first flexible member is provided with a first sleeving opening; the first sleeving opening is configured to be connected to the container.

15. The container sealing plug according to claim 14, wherein two adjacent slits of the slits are perpendicular to each other.

16. The container sealing plug according to claim 14, the first flexible member is further provided with a hanging space.

17. A container sealing plug, comprising:

a plug body, wherein the plug body is configured to seal a receiving opening of a container; the plug body comprises a sealing part; the sealing part is configured to seal the receiving opening of the container; the sealing part is provided with an elastic sealing ring; and the sealing ring is configured to press an inner wall that seals the receiving opening of the sealed container;

wherein the plug body comprises a first upper side and a first lower side; the plug body further comprises a first stop part; the first stop part is arranged between the first upper side and the first lower side; and the sealing part is arranged between the first lower side and the first stop part;

wherein the first lower side is provided with a first opening; the first upper side is provided with a second opening; the first opening is intercommunicated with the second opening; and when the first lower side of the plug body is inserted into the receiving opening of the container, the second opening is inserted into the container along with the plug body, and the first upper side is exposed out of the container, whereby the second opening on the first upper side is exposed out of the container; wherein the first stop part is exposed out of the container;

wherein the container sealing plug further comprises a cover body and a second flexible member, wherein the cover body is connected to the plug body through the second flexible member, and the cover body is detachably covered at the second opening;

wherein a diameter of the first stop part extending in a horizontal direction is larger than a diameter of the first upper side, the diameter of the first stop part is larger than a diameter of the first lower side, and the diameter of the first stop part is larger than a diameter of the sealing ring.

18. The container sealing plug according to claim 17, wherein a leak-proof part is arranged at the second opening, and the leak-proof part comprises a plurality of flexible leak-proof baffles and slits; the flexible leak-proof baffles press one another to cover the slits; and when the flexible leak-proof baffles are acted upon by an external force that is greater than a pressing force generated by the flexible leak-proof baffles pressing one another, the flexible leak-proof baffles uncover the slits.

* * * * *